US007682041B2

(12) United States Patent
Lin

(10) Patent No.: US 7,682,041 B2
(45) Date of Patent: Mar. 23, 2010

(54) LED PROJECTOR LAMP

(75) Inventor: Mark Lin, Taichung County (TW)

(73) Assignee: Genius Electronic Optical Co., Ltd., Taichung County (TW)

( * ) Notice: Subject to any disclaimer, the term of this patent is extended or adjusted under 35 U.S.C. 154(b) by 110 days.

(21) Appl. No.: 12/139,103

(22) Filed: Jun. 13, 2008

(65) Prior Publication Data

US 2009/0154153 A1 Jun. 18, 2009

(30) Foreign Application Priority Data

Dec. 12, 2007 (TW) ..... 96221129 U

(51) Int. Cl.
*F21V 9/00* (2006.01)

(52) U.S. Cl. ..... 362/231; 362/230

(58) Field of Classification Search ..... 362/230, 362/231

See application file for complete search history.

(56) References Cited

U.S. PATENT DOCUMENTS

2008/0186700 A1 * 8/2008 Curran et al. ..... 362/230

* cited by examiner

*Primary Examiner*—David V Bruce
(74) *Attorney, Agent, or Firm*—Browdy & Neimark, PLLC

(57) ABSTRACT

An LED projector lamp includes, in succession along an optical axis thereof, a lamp holder, an LED light source, a light-mixing lens and a cover lens. The LED light source has LED chips arranged inside the lamp holder around the optical axis for emitting different wavelengths of light. The light-mixing lens has a structural surface with parallel lines of protrusions facing the cover lens such that such that the emitted light rays of the LED chips that pass through the structural surface are scattered at least one time and then pass through the cover lens. As a result, the emitted different wavelengths of light can be well mixed before going to the outside of the LED projector lamp.

6 Claims, 3 Drawing Sheets

LED PROJECTOR LAMP

BACKGROUND OF THE INVENTION

1. Field of the Invention

The present invention relates to projector lamps and more particularly, to an LED projector lamp that has the emitted different wavelengths of light be well mixed before projection to the outside.

2. Description of the Related Art

White LED has been intensively used in the lighting market for the advantages of energy saving, environmental protection and long service life.

FIG. 1 illustrates a white light LED projector lamp according to the prior art. According to this design, the white light LED projector lamp 1 comprises a bowl-shaped lamp holder 2, an LED light source 3 mounted in the inner bottom side of the lamp holder 2 and formed of a red LED, a green LED and a blue LED that are arranged in a line, and a convex lens 4 covered on open side of the lamp holder 2. During working of the white light LED projector lamp 1, a voltage is provided to the LED chips of the LED light source 3, driving them to emit light. The intersected portions of these light rays are well mixed, producing a white light beam that is condensed by the convex lens 4 to enhance the brightness.

According to the aforesaid prior art design, not all the emitted light rays of the different colors of LED chips are mixed, and the light rays that are not mixed and go directly to the outside produce a halo around the projection zone. This drawback limits the application of the white light LED projector lamp.

SUMMARY OF THE INVENTION

The present invention has been accomplished under the circumstances in view. It is the primary objective of the present invention to provide an LED projector lamp, which has the emitted light rays of different colors of LED chips be well mixed by means of an optical structure before projection to the outside, eliminating the problem of a halo around the projection zone.

To achieve this objective of the present invention, the LED projector lamp comprises, in succession along an optical axis thereof, a lamp holder, an LED light source, a light-mixing lens and a cover lens. The lamp holder has a first bearing portion and a second bearing portion spacedly disposed along the optical axis of the LED. The LED light source is mounted to the first bearing portion of the lamp holder and has a plurality of LED chips symmetrically arranged around the optical axis for emitting different wavelengths of light in direction from the first bearing portion toward the second bearing portion. The cover lens is mounted to the second bearing portion of the lamp holder in such a manner that the optical axis passes through a center of the cover lens. The light-mixing lens is located along the optical axis between the LED light source and the cover lens and has a structural surface facing the cover lens and having a plurality of lines of protrusions arranged in parallel, such that the emitted light rays of the LED chips passing through the structural surface are scattered at least one time and then pass through the cover lens.

By means of the arrangement of the light-mixing lens between the cover lens and the LED light source and the effect of the special optical structure of the light-mixing lens, the emitted different wavelengths of light of the LED light source are well mixed before going through the cover lens to the outside of the LED projector lamp, improving light uniformity and brightness in the projection zone and eliminating the halo effect of the prior art design.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
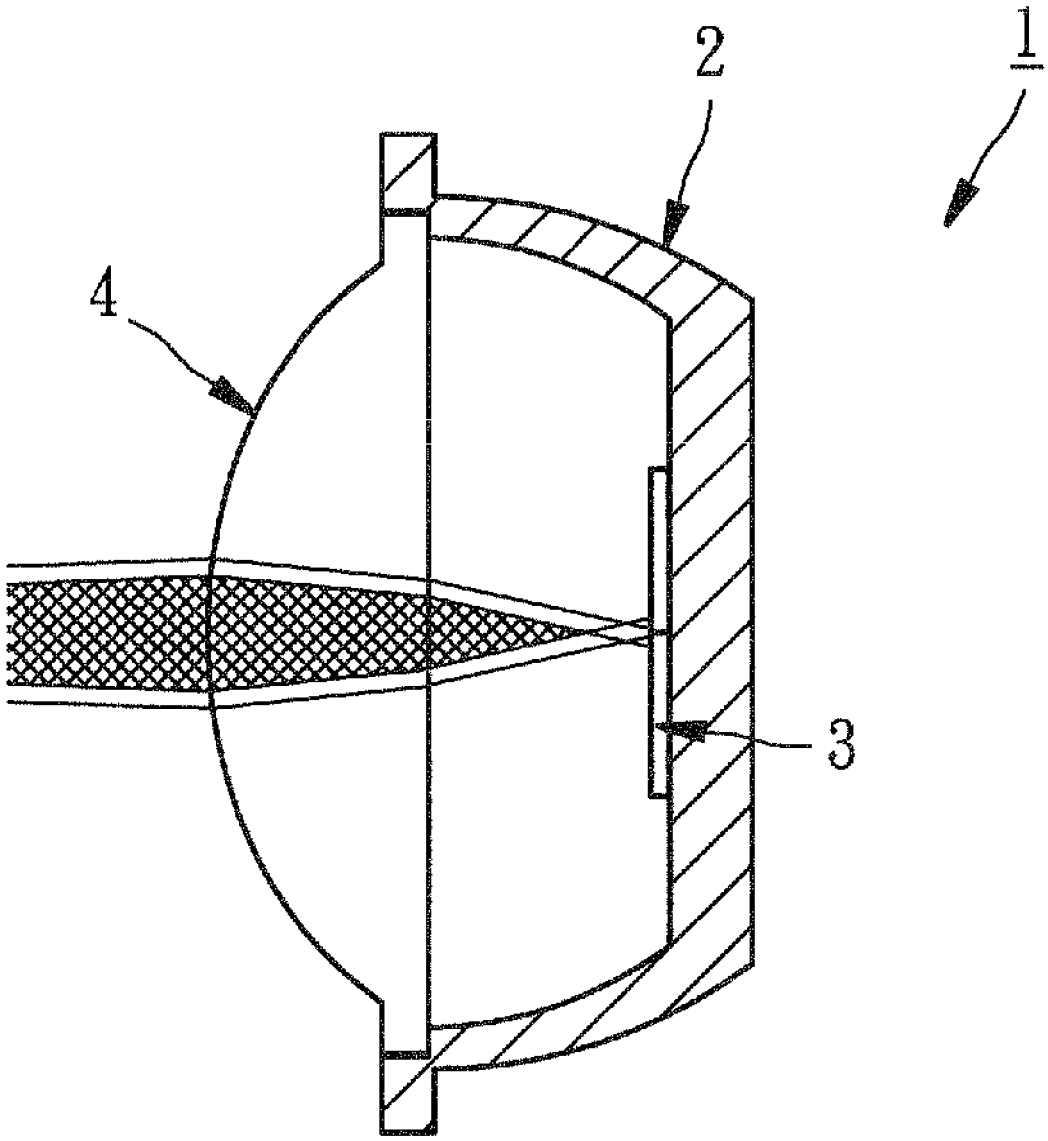
FIG. 1 PRIOR ART
FIG. 1 is a schematic sectional view of a white light LED projector lamp according to the prior art.
Figure 2:
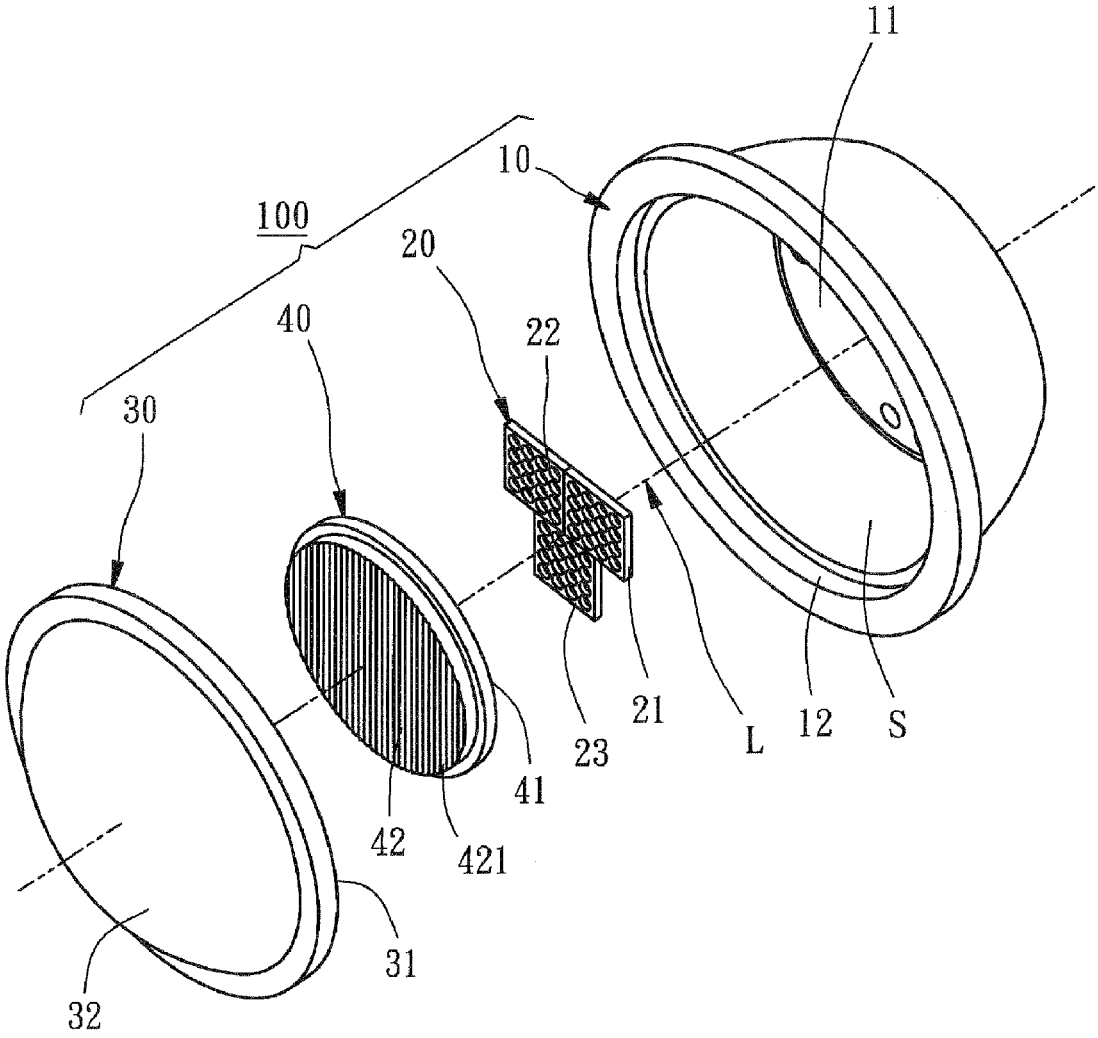
FIG. 2 is an exploded view of an LED projector lamp in accordance with a preferred embodiment of the present invention.
Figure 3:
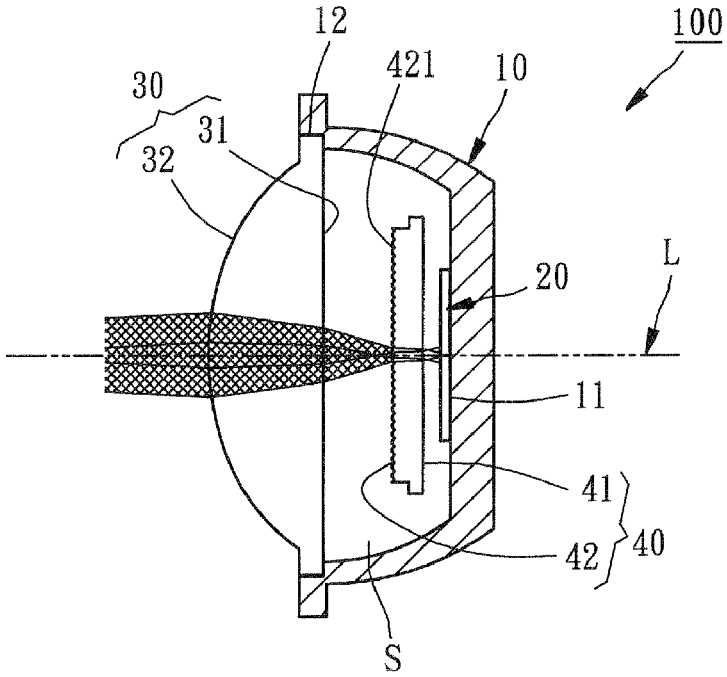
FIG. 3 is a schematic sectional view of the LED projector lamp in accordance with the preferred embodiment of the present invention.

Referring to FIGS. 2 and 3, an LED projector lamp 100 in accordance with a preferred embodiment of the present invention is shown comprising a lamp holder 10, an LED light source 20, a light-mixing lens 40 and a cover lens 30 arranged along an optical axis L in proper order.

The lamp holder 10 is a hollow container having a first bearing portion 11 on the deep inside, a second bearing portion 12 around the opening, and an accommodation open chamber S defined between the first bearing portion 11 and the second bearing portion 12.

Figure 4:
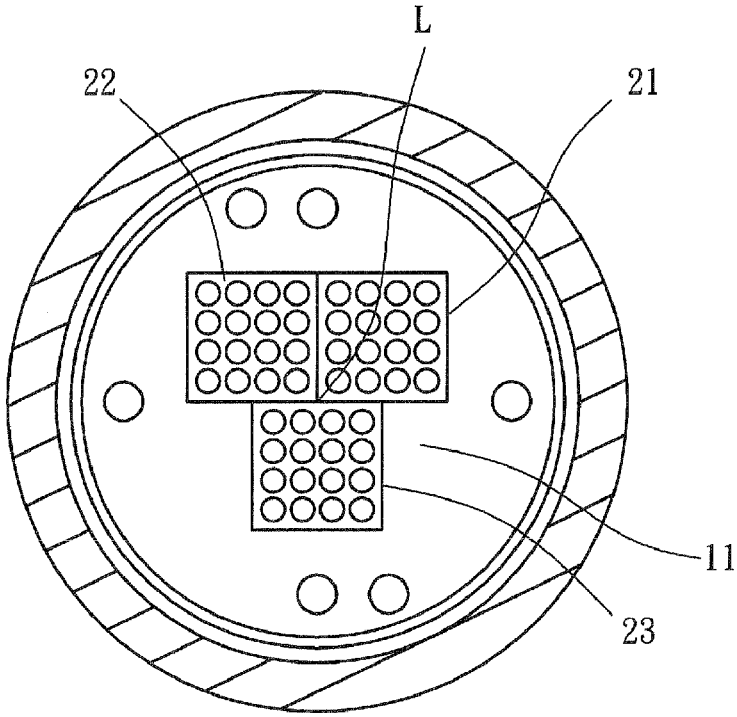
FIG. 4 is a sectional view taken along line 4-4 of FIG. 3.

The LED light source 20 is fastened to the first bearing portion 11 inside the lamp holder 10 and electrically connected to a power source (not shown). Referring also to FIG. 4, the LED light source 20 according to the present preferred embodiment is comprised of three LED chips 21, 22 and 23 that emit different wavelengths of light in direction from the first bearing portion 11 toward the second bearing portion 12. The LED chips 21, 22 and 23 respectively emit red light, green light and blue light, which can be mixed into white light. It is to be understood that the LED chips 21, 22 and 23 are arranged on one same plane (i.e., the first bearing portion 11) around the optical axis L, having the same intensity of light. This arrangement provides a wide color mixing zone and the white light that is obtained after mixing has the highest chroma.

The cover lens 30 according to the present preferred embodiment, as shown in FIGS. 2 and 3, is a condensing lens fastened to the second bearing portion 12 to close the accommodation open chamber S of the lamp holder 10. The cover lens 30 has a planar surface 31 on one side that faces the accommodation open chamber S, and a convex surface 32 on the other side opposite to the planar surface 31. The cover lens 30 concentrates the light passing therethrough, enhancing the brightness.

The light-mixing lens 40 is fastened to the lamp holder 10 by means of any of a variety of mounting techniques and positioned inside the accommodation open chamber S, as shown in FIGS. 2 and 3. For example, screws are used to affix the light-mixing lens 40 inside the accommodation open chamber S of the lamp holder 10. The light-mixing lens 40 is located on the optical axis L between the LED light source 20 and the cover lens 30. The light-mixing lens 40 has a planar surface 41 disposed on one side thereof and facing the LED light source 20, and a structural surface 42 disposed on the other side thereof opposite to the planar surface 41. The structural surface 42 has parallel lines of protrusions 421 formed thereon in integrity. Alternatively, the parallel lines of protrusions 421 may be separately made and then directly bonded to the structural surface 42. Each line of protrusion 421 has a curved surface. The parallel lines of protrusions 421 interfere with the light rays that go through the structural surface 42 so that these different wavelengths of light rays are diffused several times and then projected toward the cover lens 30. Therefore, different colors of light are well mixed before going through the cover lens 30 to the outside of the LED projector lamp 100.

After understanding of the structural features of the LED projector lamp 100, the application of the LED projector lamp 100 is explained hereinafter. The three LED chips 21, 22 and 23 of the LED light source 20 are driven by the power source to emit different colors of light. Because the three LED chips 21, 22 and 23 of the LED light source 20 are arranged around the optical axis L, the color mixing zone is relatively greater then the conventional linear arrangement method. When light rays go from the LED chips 21, 22 and 23 through the light-mixing lens 40, they are well mixed subject to the optical interference effect of the parallel lines of protrusions 421 of the structural surface 42, and the bundles of unmixed light rays is minimized, and therefore the invention eliminates the problem of halo effect around the projection zone. The well-mixed light rays go through the cover lens 30 to the outside. In other words, the LED projector lamp 100 projects one single light beam of white color along the optical axis L, improving light uniformity and brightness in the projection zone and eliminating the halo effect of the prior art design.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An LED projector lamp comprising:

a lamp holder having a first bearing portion and a second bearing portion along an optical axis of the LED;

a LED light source mounted to the first bearing portion of the lamp holder and provided with a plurality of LED chips symmetrically arranged relative to the optical axis for emitting different wavelengths of light in direction from the first bearing portion toward the second bearing portion, a cover lens mounted to the second bearing portion of the lamp holder in such a manner that the optical axis passes through a center of the cover lens; and a light-mixing lens located along the optical axis between the LED light source and the cover lens and provided with a structural surface facing the cover lens and having a plurality of lines of protrusions arranged in parallel, such that the emitted light rays of the LED chips passing through the structural surface are scattered at least one time and then pass through the cover lens.

2. The LED projector lamp as claimed in claim 1, wherein the LED chips of the LED light source comprise a red color LED chip, a green color LED chip and a blue color LED chip arranged on a same plane around the optical axis.

3. The LED projector lamp as claimed in claim 2, wherein the red color LED chip, the green color LED chip and the blue color LED chip have a same luminous intensity.

4. The LED projector lamp as claimed in claim 3, wherein the emitted light rays of the red color LED chip, the green color LED chip and the blue color LED chip form a single white light beam on the optical axis after passing through the light-mixing lens and the cover lens.

5. The LED projector lamp as claimed in claim 4, wherein the lines of protrusions of the structural surface of the light-mixing lens each have a curved surface.

6. The LED projector lamp as claimed in claim 5, wherein the cover lens is a condensing lens.

* * * * *